US010906726B2

(12) United States Patent
Mabe et al.

(10) Patent No.: US 10,906,726 B2
(45) Date of Patent: Feb. 2, 2021

(54) DISPENSING SYSTEM FOR A TOBACCO-RELATED PRODUCT, AND ASSOCIATED METHOD

(71) Applicant: R. J. REYNOLDS TOBACCO COMPANY, Winston-Salem, NC (US)

(72) Inventors: Jeremy Barrett Mabe, Lexington, NC (US); Darrell Eugene Holton, Jr., Clemmons, NC (US); Daniel Verdin Cantrell, Lewisville, NC (US); Barry Smith Fagg, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 1131 days.

(21) Appl. No.: 14/242,272

(22) Filed: Apr. 1, 2014

(65) Prior Publication Data

US 2015/0274401 A1 Oct. 1, 2015

(51) Int. Cl.
*A24F 23/00* (2006.01)
*B65D 83/00* (2006.01)
*A45D 40/04* (2006.01)

(52) U.S. Cl.
CPC ..... *B65D 83/0011* (2013.01); *A24F 23/00* (2013.01); *A45D 40/04* (2013.01)

(58) Field of Classification Search
CPC ..... A24F 23/00
USPC ..... 206/238, 241
See application file for complete search history.

(56) References Cited

U.S. PATENT DOCUMENTS 214,639 A * 4/1879 Emery ..... A24B 13/00 131/366
842,065 A * 1/1907 Behrman ..... B65D 71/504 131/250
2,274,238 A * 2/1942 Henderson ..... A47F 1/06 211/59.3
3,166,078 A * 1/1965 Parmele ..... A24B 3/14 131/366
4,190,170 A 2/1980 Boyd
4,501,283 A 2/1985 Webb
4,589,575 A * 5/1986 Rigberg et al. .... B65D 83/0418 206/535
4,605,330 A 8/1986 Crowley et al.
4,749,106 A 6/1988 Von Schuckmann et al.
(Continued)

FOREIGN PATENT DOCUMENTS

EP 2 543 610 A1 1/2013
GB 2493979 A 2/2013
(Continued)

OTHER PUBLICATIONS

Japanese Office Action dated Jan. 8, 2019.

*Primary Examiner* — Michael H. Wilson
*Assistant Examiner* — Dionne W. Mayes
(74) *Attorney, Agent, or Firm* — Womble Bond Dickinson (US) LLP

(57) ABSTRACT

A dispensing system for a tobacco-related product is provided, including a tubular member having a dispensing end, and a heterogeneous tobacco-related product received within the tubular member. A dispensing mechanism is operably engaged with the tubular member, and is configured to direct an amount of the heterogeneous tobacco-related product outwardly of the tubular member through the dispensing end for consumption by a user. An associated method is also provided.

15 Claims, 9 Drawing Sheets

(56) References Cited

U.S. PATENT DOCUMENTS

| | | | | |
|---|---|---|---|---|
| 4,932,803 | A | 6/1990 | Goldberger et al. | |
| 5,007,755 | A | 4/1991 | Thompson | |
| 5,387,416 | A | 2/1995 | White et al. | |
| 6,136,352 | A * | 10/2000 | Silverstein et al. | A45D 40/10 206/817 |
| 7,014,039 | B2 | 3/2006 | Henson et al. | |
| 7,105,173 | B1 | 9/2006 | Rolling | |
| 7,147,393 | B2 | 12/2006 | Yoon | |
| D592,956 | S | 5/2009 | Thiellier | |
| 7,537,110 | B2 | 5/2009 | Kutsch et al. | |
| D594,154 | S | 6/2009 | Patel et al. | |
| 7,584,843 | B2 | 9/2009 | Kutsch et al. | |
| 8,215,482 | B2 | 7/2012 | Cronin et al. | |
| 8,511,922 | B2 | 8/2013 | Prischak | |
| 8,556,070 | B2 | 10/2013 | Bried et al. | |
| 8,635,847 | B2 | 1/2014 | Knudsen | |
| 2005/0106192 | A1 | 5/2005 | Parekh et al. | |
| 2005/0244521 | A1 | 11/2005 | Strickland et al. | |
| 2006/0191548 | A1* | 8/2006 | Strickland et al. | A24B 3/14 131/347 |
| 2006/0193676 | A1* | 8/2006 | Gordon | A23G 1/20 401/55 |
| 2008/0173317 | A1 | 7/2008 | Robinson et al. | |
| 2009/0014343 | A1 | 1/2009 | Clark et al. | |
| 2009/0014450 | A1 | 1/2009 | Bjorkholm | |
| 2009/0223989 | A1 | 9/2009 | Gelardi | |
| 2009/0230003 | A1 | 9/2009 | Thiellier | |
| 2009/0250360 | A1 | 10/2009 | Bellamah et al. | |
| 2009/0266837 | A1 | 10/2009 | Gelardi et al. | |
| 2010/0084424 | A1 | 4/2010 | Gelardi | |
| 2010/0133140 | A1 | 6/2010 | Bailey et al. | |
| 2010/0217176 | A1 | 8/2010 | Carrara et al. | |
| 2010/0264157 | A1 | 10/2010 | Bailey et al. | |
| 2011/0168712 | A1 | 7/2011 | Bailey et al. | |
| 2011/0204074 | A1 | 8/2011 | Gelardi et al. | |
| 2011/0220130 | A1 | 9/2011 | Mua et al. | |
| 2011/0303511 | A1 | 12/2011 | Brinkley et al. | |
| 2012/0193265 | A1 | 8/2012 | Patel et al. | |
| 2013/0206150 | A1 | 8/2013 | Duggins et al. | |
| 2013/0206153 | A1 | 8/2013 | Beeson et al. | |
| 2013/0263870 | A1 | 10/2013 | Cantrell et al. | |
| 2013/0274296 | A1 | 10/2013 | Jackson et al. | |
| 2013/0312774 | A1 | 11/2013 | Holton, Jr. | |

FOREIGN PATENT DOCUMENTS

| | | | |
|---|---|---|---|
| WO | WO 2008/070032 | A2 | 6/2008 |
| WO | WO 2011/108373 | A1 | 9/2011 |
| WO | WO 2011/114864 | A1 | 9/2011 |

* cited by examiner

DISPENSING SYSTEM FOR A TOBACCO-RELATED PRODUCT, AND ASSOCIATED METHOD

BACKGROUND

1. Field of the Disclosure

The present disclosure relates to products made or derived from tobacco, or that otherwise incorporate tobacco or components of tobacco, and are intended for human consumption. Of particular interest are ingredients or components obtained or derived from plants or portions of plants from the *Nicotiana* species, as well as the containers suitable for containing formulations incorporating such ingredients or components for subsequent dispensation to and by a user.

2. Disclosure of Related Art

Cigarettes, cigars and pipes are popular smoking articles that employ tobacco in various forms. For example, a traditional type of cigarette has a substantially cylindrical rod-shaped structure and includes a charge, roll or column of smokable material, such as shredded tobacco (e.g., in cut filler form), surrounded by a paper wrapper, thereby forming a so-called "smokable rod," "tobacco rod" or "cigarette rod." Tobacco also may be enjoyed in a so-called smokeless form. Particularly popular smokeless tobacco products are employed by inserting some form of processed tobacco or tobacco-containing formulation into the mouth of the user. See, for example, the types of representative smokeless tobacco products, as well as the various smokeless tobacco formulations, ingredients and processing methodologies, described, discussed and referenced in U.S. Pat. Pub. Nos. 2011/0303511 to Brinkley et al. and 2013/0206150 to Duggins et al.; which are incorporated herein by reference.

Typically, popular smokeless tobacco products are packaged for commercial distribution in containers that are referred to as "pouches," "pucks" or "tins." In addition, variations of containers and packaging for smokeless tobacco containers have been proposed. See, for example, the various types of containers for tobacco products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 8,556,070 to Bried et al.; D592,956 to Thiellier; D594,154 to Patel et al.; and US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; 2010/0133140 to Bailey et al; 2010/0264157 to Bailey et al.; 2011/0168712 to Bailey et al.; and 2011/0204074 to Gelardi et al., which are incorporated herein by reference.

In this regard, it would be desirable to provide an enjoyable and satisfying form of a tobacco product, such as a smokeless tobacco product, and to provide an efficient and effective manner or method for packaging, presenting, and dispensing such a tobacco product.

SUMMARY OF THE DISCLOSURE

The above and other needs are met by aspects of the present disclosure which, in one aspect, provides a dispensing system for a tobacco-related product, including a tubular member having a dispensing end, and a heterogeneous tobacco-related product received within the tubular member.

A dispensing mechanism is operably engaged with the tubular member, and is configured to direct an amount of the heterogeneous tobacco-related product outwardly of the tubular member through the dispensing end for consumption by a user.

In another aspect, a method of dispensing a tobacco-related product is provided. Such a method may comprise actuating a dispensing mechanism operably engaged with a tubular member having a dispensing end, with the tubular member being in receipt of a heterogeneous tobacco-related product therein; and directing an amount of the heterogeneous tobacco-related product outwardly of the tubular member through the dispensing end, in response to actuation of the dispensing mechanism.

Further features and advantages of the present disclosure are set forth in more detail in the following description.

BRIEF DESCRIPTION OF THE DRAWINGS

Figure 1:
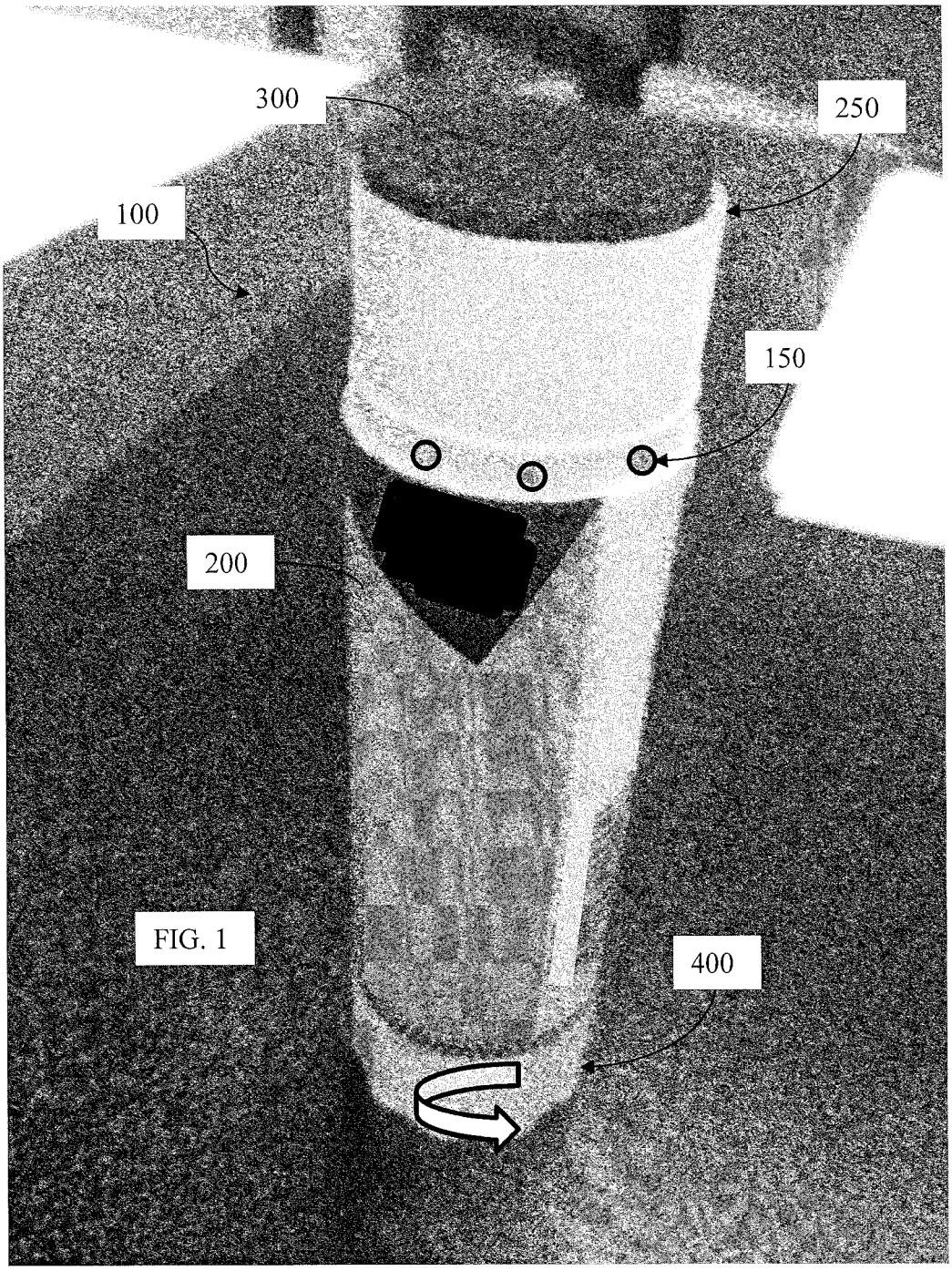
Figure 2:
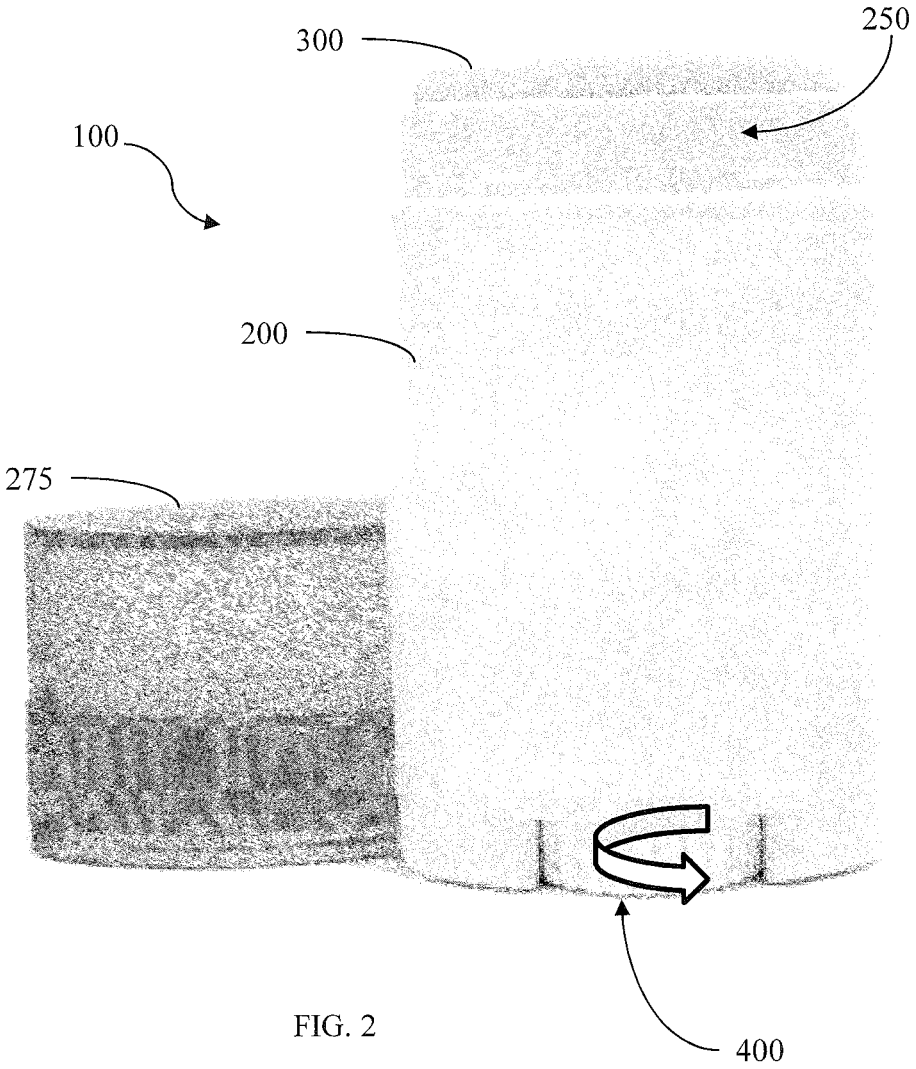
Figure 3:
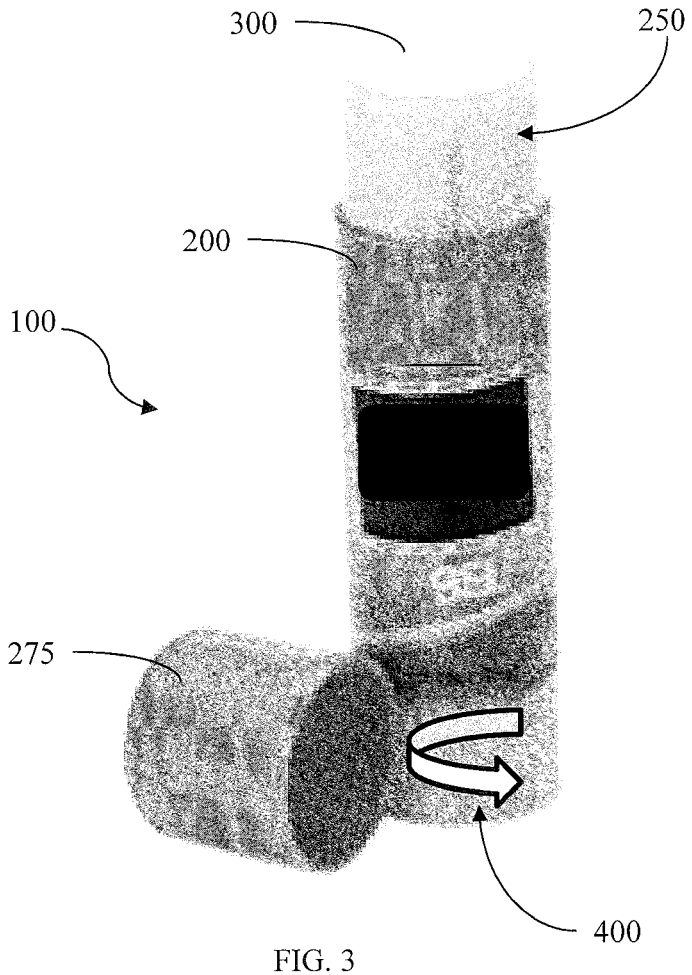
Figure 4:
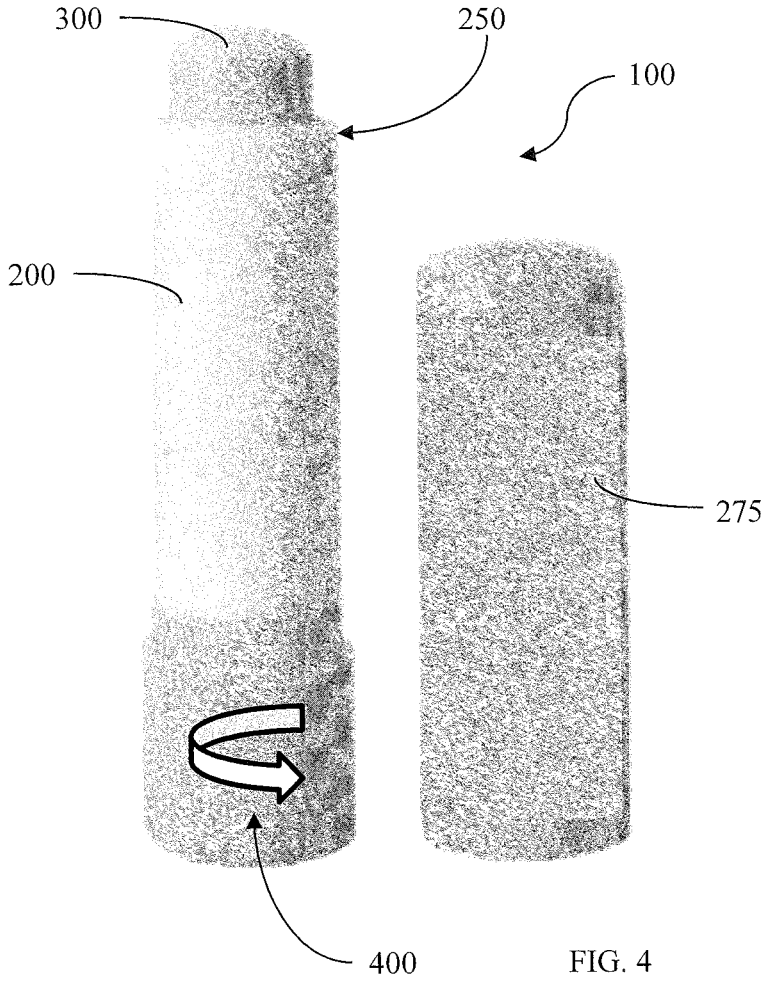
Figure 5:
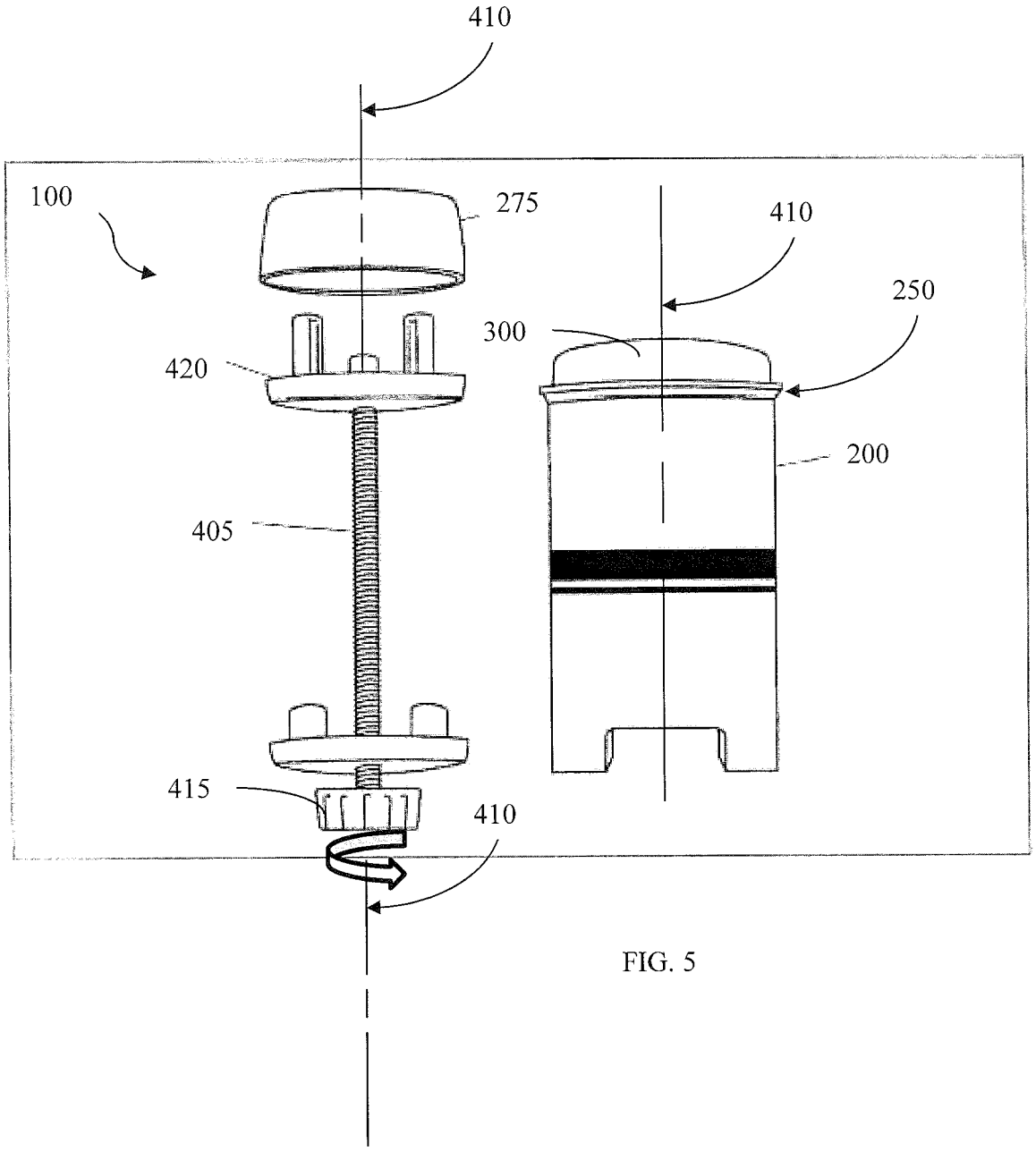

Having thus described the disclosure in general terms, reference will now be made to the accompanying drawings, which are not necessarily drawn to scale, and wherein:

FIG. 1 schematically illustrates a dispensing system for a tobacco-related product, according to one aspect of the present disclosure;

FIG. 2 schematically illustrates a dispensing system for a tobacco-related product, implementing a type of container typically used for deodorant and antiperspirant products, according to another aspect of the present disclosure;

FIG. 3 schematically illustrates a dispensing system for a tobacco-related product, implementing a type of container typically used for solid adhesive or glue stick products, according to another aspect of the present disclosure;

FIG. 4 schematically illustrates a dispensing system for a tobacco-related product, implementing a type of container typically used for lip balm products, according to another aspect of the present disclosure;

FIG. 5 schematically illustrates an exploded view of a dispensing system for a tobacco-related product, according to one aspect of the present disclosure; and FIGS. 6-9 each schematically illustrate a dispensing system for a tobacco-related product, according to various aspects of the present disclosure.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will be thorough and complete, will fully convey the scope of the disclosure to those skilled in the art, and will satisfy applicable legal requirements. Like numbers refer to like elements throughout. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

FIG. 1 schematically illustrates one exemplary aspect of a dispensing system for dispensing a tobacco-related material or product, according to the present disclosure, the system being generally designated by the numeral 100. Such a system 100 generally includes a tubular member 200 having a dispensing end 250. A tobacco-related material or product 300, such as a heterogeneous tobacco-related product, may be received within the tubular member 200 in various manners as more particularly disclosed herein. In particular aspects, a dispensing mechanism 400 may be operably engaged with the tubular member 200, generally but not necessarily opposite to the dispensing end 250. The dispensing mechanism 400 may be configured to direct an amount (i.e., a predetermined portion) of the tobacco-related product 300 outwardly of the tubular member 200 through the dispensing end 250. In some aspects, the dispensed tobacco-related product 300 may be particularly configured to be ingestible by a user, or at least configured to be received orally by the user (i.e., within the mouth of the user). In some instances, the dispensed tobacco-related product 300 may be particularly configured to be ingestible or orally-received, without being touched by the hands of the user. In other instances, the dispensed tobacco-related product 300 may be configured and arranged to be dispensed directly into the mouth of the user so as to be orally chewed or swallowed. In being so dispensed, the tobacco-related product 300 may be, in some instances, configured to be orally dissolvable or disintegratable.

Certain containers (i.e., including a tubular member 200 and a dispensing mechanism 400) can have the features of those types of containers that have been used commercially, for example, for those types of deodorant and antiperspirant products that are characterized as solids or gels. For instance, representative containers that can be employed, or suitably modified, for implementation in certain aspects of the present disclosure can be those types of containers for deodorant and antiperspirant products that have been marketed, for example, by Revlon, Unilever, Dial Corporation, The Proctor and Gamble Company, Colgate-Palmolive Company and Idelle Labs, Ltd. See, e.g., FIG. 2. See also, for example, U.S. Pat. No. 4,605,330 to Crowley et al.; U.S. Pat. No. 4,932,803 to Goldberger et al.; U.S. Pat. No. 5,007,755 to Thompson and U.S. Pat. No. 8,511,922 to Prischak, which are each incorporated herein by reference.

Certain other containers (i.e., including a tubular member 200 and a dispensing mechanism 400) can have the features of those types of containers that have been used commercially, for example, for those types of glue products that are characterized as solid adhesives or those that are characterized as sticks. For instance, representative containers that can be employed, or suitably modified, for implementation in certain aspects of the present disclosure can be those types of containers for glue stick types of products that have been marketed, for example, by 3M, Henkel, Bostik SA, Societe BIC and Elmer's Products, Inc. See, e.g., FIG. 3. See also, for example, U.S. Pat. No. 7,147,393 to Yoon, which are each incorporated herein by reference.

Still certain other containers (i.e., including a tubular member 200 and a dispensing mechanism 400) can have the features of those types of containers that have been used commercially, for example, for those types of products that are characterized as lip balms or lipsticks. For instance, representative containers that can be employed, or suitably modified, are those types of containers for lip balm types of products that have been marketed by Pfizer Consumer Healthcare, The Clorox Company and Neutrogena Corporation. Representative types of such containers also are available commercially from sources such as Rustic Escentuals, LLC. See, e.g., FIG. 4. See, also, for example, U.S. Pat. No. 7,105,173 to Rowling, which are each incorporated herein by reference.

In particular aspects, as shown, for example, in FIGS. 2-4, the container (i.e., including a tubular member 200 and a dispensing mechanism 400) of the various types and applications disclosed herein, may also include a cap or closure member 275 operably engaged with the dispensing end 250 of the tubular member 200. The cap or closure member 275, when normally closed with respect to the dispensing end 250, is configured to at least partially retain the tobacco-related product 300 within the tubular member 200. In use of the dispensing system 100, the cap or closure member 275 may be removable from the dispensing end 250 so as to expose the tobacco-related product 300 within the tubular member 200, through the dispensing end 250.

In one such aspect, as shown in FIG. 5, the tubular portion/member 200 may be held in one hand of the user, while the dispensing (i.e., ejection) mechanism 400, in some instances located at the end of that tubular member 200 opposite to the dispensing end 250, is twisted, torqued, pushed toward the dispensing end 250, or otherwise mechanically-actuated by the other hand of the user. That is, the container or tubular member 200 may include a "twist advance" movable platform or base 420 disposed within the tubular member 200, wherein in use, the rotatable portion (i.e., knob or actuator 415) can be rotated in one direction to propel (eject or dispense) the tobacco-related product 300 from, or in the opposite direction to retract (recess or withdraw) the tobacco-related product 300 into, the tubular member 200 forming the container. The use of the container in such a manner may allow the tobacco-related product to be evenly, consistently, and cleanly dispensed from the container in the amount or predetermined portion for consumption by the user. As such, actuation of the dispensing mechanism 400 results is a controlled amount or predetermined portion of the tobacco-related product 300/tobacco material to be forced or dispensed out of the dispensing end 250 of the tubular portion/member 200. A pre-selected, desired amount of tobacco-related product 300 can thus be removed from the tubular member 200 (i.e., container) for consumption, in some instances without the necessity of the user having to touch the tobacco material or tobacco-related product 300 with his/her hands.

In some instances, the closure member 275 engaged with the dispensing end 250 of the tubular member 200, may be configured to close, cap, or seal the dispensing end 250 when in the (normally) closed position, and to allow the heterogeneous tobacco-related product 300 to be dispensed through the dispensing end 250 when in the open position. In such instances, as shown, for example, in FIG. 6, the closure member 275 may be further configured to move laterally between the open position and closed position (i.e., pivoting in the plane of the dispensing end 250, about a pivot point disposed externally to the dispensing end 250). The scissor-like lateral movement of the closure member 275 between the open and closed positions may cause the closure member 275 to function as a separating arrangement configured to sever or otherwise separate a dispensed portion of the heterogeneous tobacco-related product 300, disposed externally to the dispensing end 250, from a remaining portion of the heterogeneous tobacco-related product 300 remaining within the tubular member 200. The user may, therefore, not have to touch or handle the dispensed portion in order to receive the desired portion of the tobacco-related product 300 for consumption.

Figure 6:
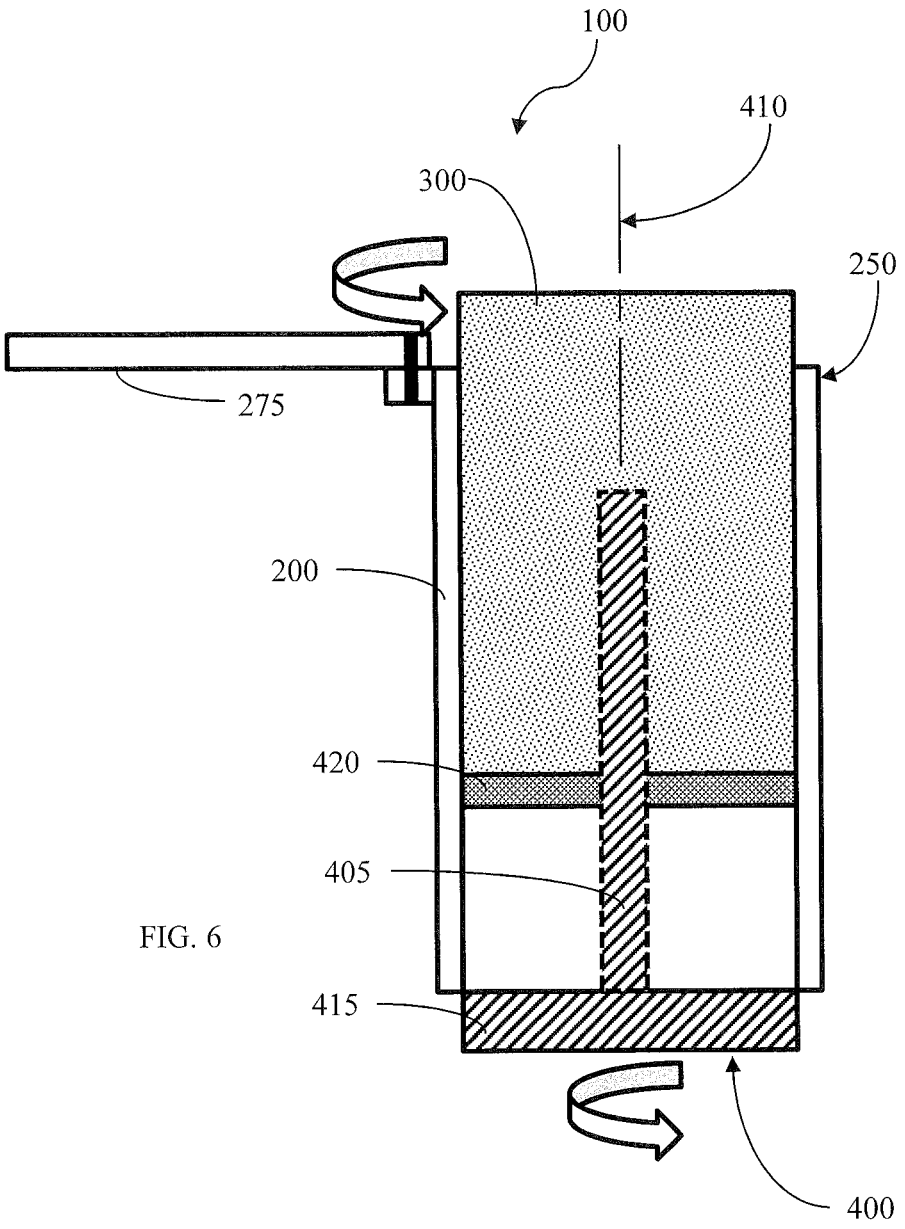
Figure 7:
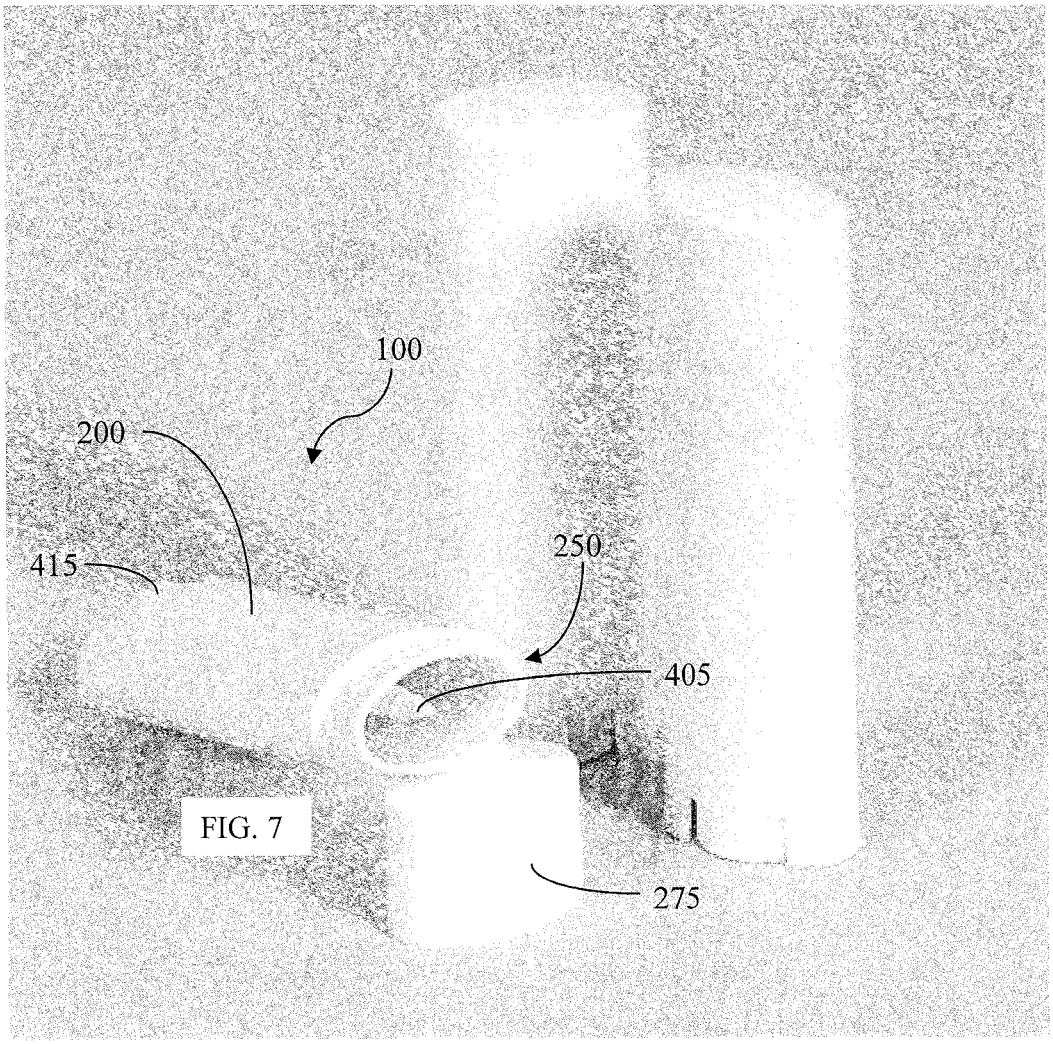

In one aspect, as shown, for example, in FIGS. 5 and 6, the dispensing mechanism 400 may comprise, for example, an elongate threaded member 405 extending along a longitudinal axis 410 of the tubular member 200. An actuator 415, such as a knob, may be engaged with and be configured to rotate the threaded member 405 about the longitudinal axis 410 (i.e., the actuator 415 may be fixedly engaged with the threaded member 405). A support member 420 may be in communication with the heterogeneous tobacco-related product 300 and disposed within the tubular member 200 substantially opposite to the dispensing end 250. The support member 420 may further be arranged to resist rotation about the longitudinal axis 410 (i.e., the cross-section of the tubular member 200 and the support member may both be oblong in shape (see, e.g., FIG. 7), or a circular member may define a key and a circular support member may define a keyway configured to receive the key) and to threadedly engage the threaded member 405. The support member 420 may thereby be arranged to move along the longitudinal axis 410 within the tubular member 200, in response to rotation of the threaded member 405 by the actuator 415, such that the tobacco-related material 300 disposed within the tubular member 200 is directed toward and outwardly of the dispensing end 250, as otherwise disclosed herein.

In some aspects, instead of a continuous dispensing of the tobacco-related product 300 in proportion to the extent of the actuation of the dispensing mechanism 400 (i.e., the amount or portion of the tobacco-related product 300 is dependent upon the amount of interaction between the user and the actuator 415), the dispensing mechanism 400 may be configured to be actuated in discrete increments so as to dispense a predetermined amount of the heterogeneous tobacco-related product 300 through the dispensing end 250 for each actuation increment. For example, the actuator 415 may be configured to be actuatable in discrete increments, with a predetermined amount of the discrete increments corresponding to the dispensation of a particular portion of the tobacco-related product 300 through the dispensing end 250 of the tubular member 200 (i.e., rotating the actuator 415 for a particular amount of audible "clicks" may signify that a single predetermined portion of the tobacco-related product 300 has been directed outwardly of the dispensing end 250 for removal by the user).

Figure 8:
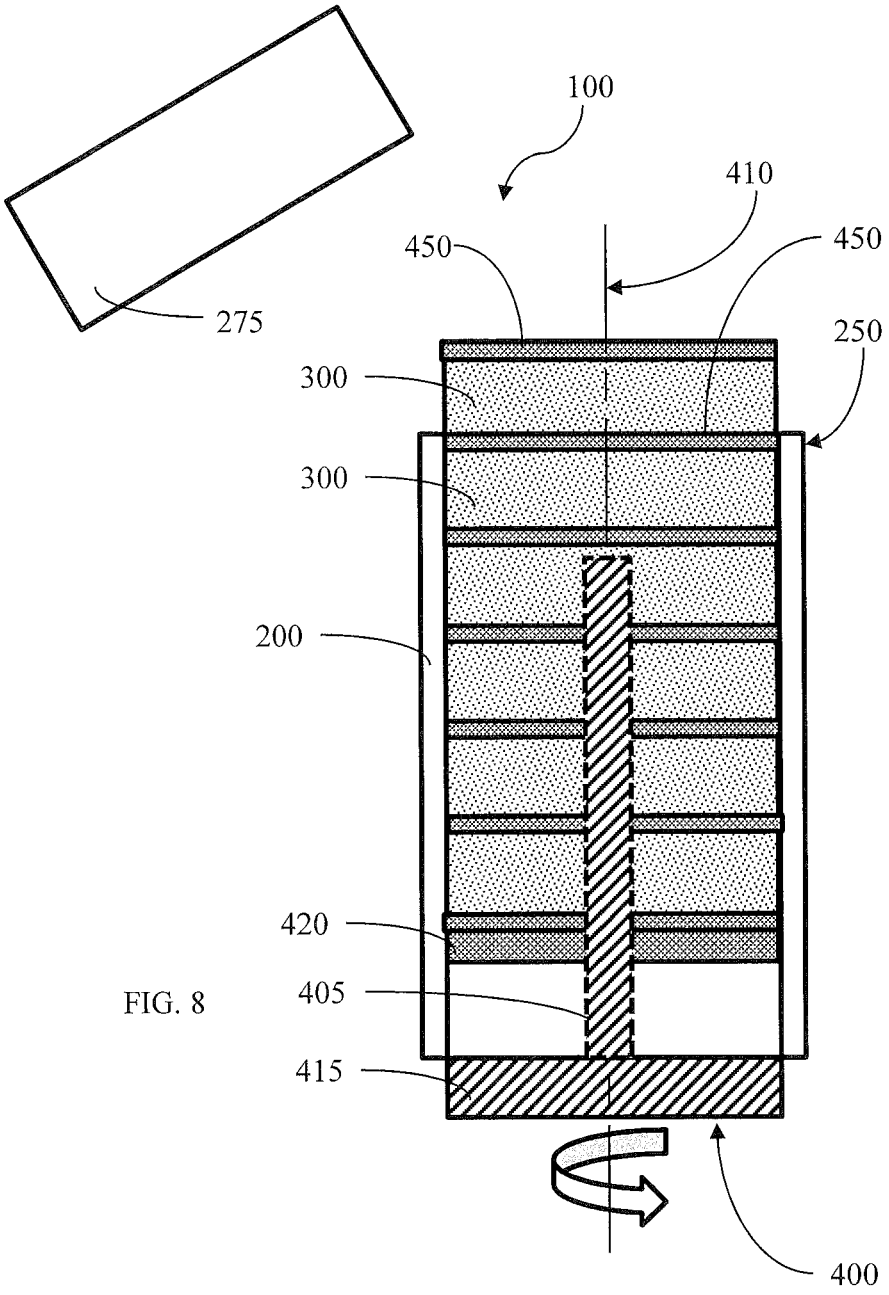

In some aspects, as shown, for example, in FIG. 8, the dispensing mechanism 400 may further comprise a plurality of spaced-apart separation members 450, with each separation member 450 being configured to separate adjacent portions of the heterogeneous tobacco-related product 300 from each other. In such instances, the dispensing mechanism 400 may be further configured such that actuation of the actuator 415 advances or otherwise dispenses one portion of the heterogeneous tobacco-related product 300, disposed between two successive separation members 450, through the dispensing end 250. Prior to the dispensation of the one portion, or in some instances, after the dispensation of that one portion, one of the separation elements 450 adjacent thereto (i.e., the outermost separation element 450 in relation to the dispensing end 250) may be removed and discarded. A subsequent actuation of the actuator 415 of the dispensing mechanism 400 may further cause a second portion of the heterogeneous tobacco-related product 300 to be dispensed through the dispensing end 250.

Figure 9:
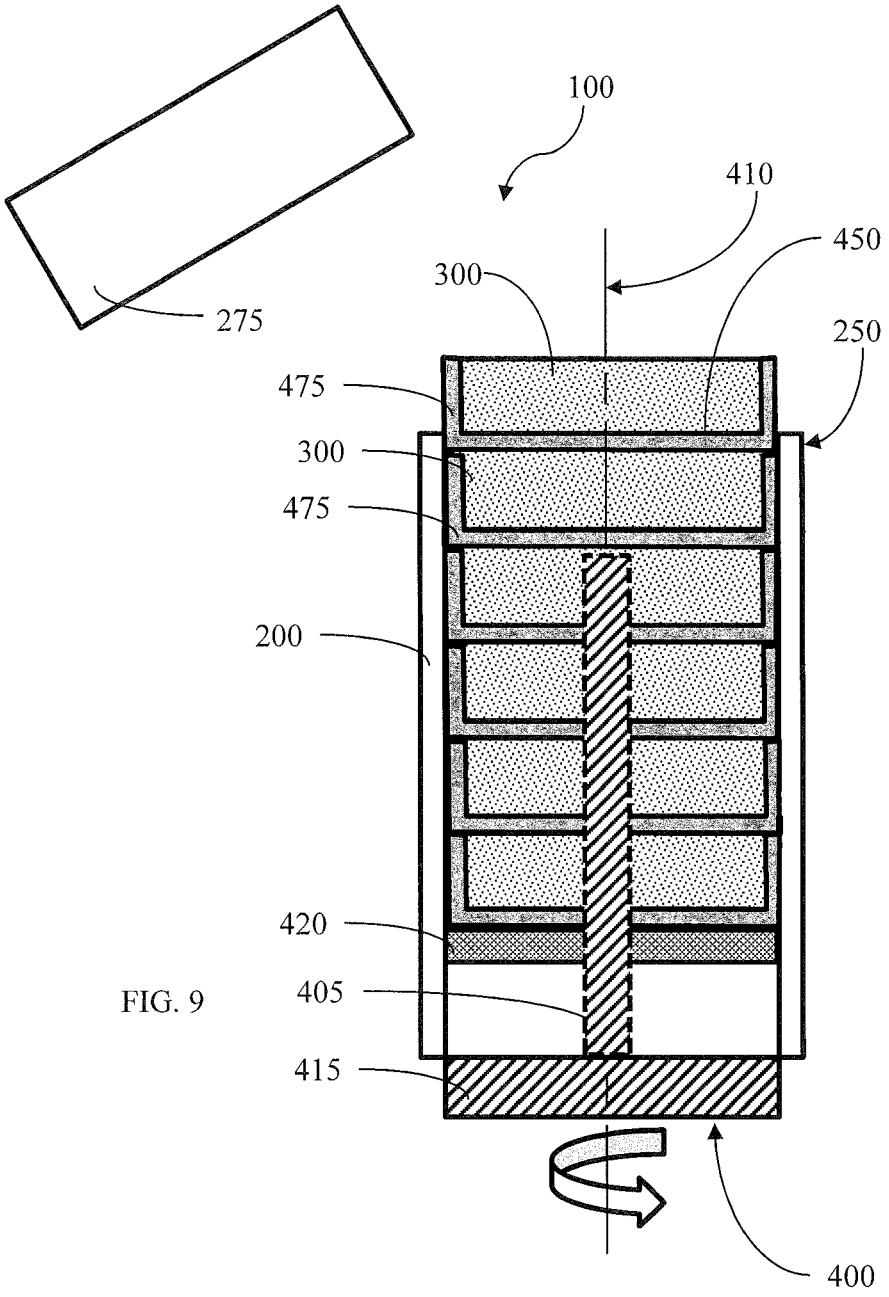

In another aspect, as shown, for example, in FIG. 9, the dispensing mechanism 400 may further comprise a plurality of container members 475, with each container member 475 containing a portion of the heterogeneous tobacco-related product 300. In such instances, the dispensing mechanism 400 may be further configured such that actuation of the actuator 415 advances or otherwise dispenses one of the container members 475 through the dispensing end 250 and permits removal of that container member 475, or the tobacco-related product 300 therein, by the user. In either instance, the dispensed container member 475 may be removed and discarded. A subsequent actuation of the actuator 415 of the dispensing mechanism 400 may further cause a second one of the container members 475 to be dispensed through the dispensing end 250.

The tobacco-related product 300 may include tobacco itself or components or elements found in or otherwise associated with tobacco. In some instances, the tobacco-related product 300 is preferably formed of a heterogeneous material (i.e., not a wax, gel, or other homogeneous material). In other instances, the tobacco-related product 300 may preferably be configured or arranged so as to be exclusive or free of a carrier matrix (i.e., tobacco without a physical support framework), though, in particular instances, the tobacco-related product 300 may include a carrier matrix so as to form individual stand-alone portions of the tobacco-related product 300. In some instances, for example, where the tobacco-related product 300 comprises a moist snuff, the tobacco-related product 300 may be characterized as portions of tobacco having a thick slurry consistency. In particular instances, the portions of tobacco forming the moist snuff are not suspended in a carrier material (i.e., the tobacco-related product does not comprise a minority or portions of tobacco suspended in a wax or gel or another homogeneous type of carrier). A moist snuff type of product may further be characterized as a product wherein the tobacco pieces have the propensity or affinity to form or stick together (i.e., to form a cohesive entity) without a carrier, but wherein the overall formulation can be characterized as more cohesive in nature than a comparable moist snuff formulation not incorporating a binder. The moisture content in a moist snuff type of product may also vary. For instance, the moisture content in a conventional moist snuff type of product may vary between about 40 parts and about 60 parts by weight, wherein it may be preferred that such a conventional moist snuff type of product have a moisture content of between about 50 parts and about 55 parts by weight. A pasteurized moist snuff type of product, however, may have relatively low moisture content. In any instance, the moist collection of tobacco pieces can be dispensed from the generally tubular container in the form of a generally cohesive portion of a collection or mixture of multiple pieces of moist snuff, in some cases, in a "dough-like" consistency. The product can be dispensed as a loosely formed mixture (e.g., a portion that is not characterized as independently granular, but rather, a form that is somewhat consistent and cohesive in its integrity, but which is capable of being dispersed into its individual or relatively smaller pieces when introduced into the mouth of the moist snuff user). Otherwise, in particular aspects, the heterogeneous tobacco-related product 300 may comprise one of moist snuff, snus, loose leaf tobacco, plug tobacco, tobacco pellets, tobacco pieces, and combinations thereof. In forming the thick slurry (or moist cohesive mass) consistency product for dispensation, the tobacco-related product may include, for example, at least tobacco and water that can be mixed or formed into a generally dough-like, moist consistency incorporating pieces of smokeless tobacco; and the slurry can optionally incorporate at least one salt (e.g., sodium chloride or potassium chloride), at least one buffer (e.g., ammonium carbonate, sodium carbonate, sodium bicarbonate, potassium carbonate, ammonium bicarbonate, or potassium bicarbonate), at least one sweetener (e.g., sucrose, glucose, high fructose corn syrup or a synthetic sweetener), flavoring agents commonly used for flavoring smokeless tobacco formulations, at least one binding agent, at least one preservative agent, and the like, as well as combinations thereof.

In particular aspects, the selection of the plant from the *Nicotiana* species utilized in the products and processes of the disclosure can vary; and in particular instances, the types of tobacco or tobaccos may vary. Tobaccos that can be implemented include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos. Descriptions of various types of tobaccos, growing practices and harvesting practices are set forth in Tobacco Production, Chemistry and Technology, Davis et al. (Eds.) (1999), which is incorporated herein by reference. Various representative types of plants from the *Nicotiana* species are set forth in Goodspeed, The Genus *Nicotiana*, (Chonica Botanica) (1954); U.S. Pat. No. 4,660,577 to Sensabaugh, Jr. et al.; U.S. Pat. No. 5,387,416 to White et al.; U.S. Pat. No. 7,025,066 to Lawson et al.; and U.S. Pat. No. 7,798,153 to Lawrence, Jr.; and US Patent Appl. Pub. Nos. 2008/0245377 to Marshall et al. and 2013/0312774 to Holton; each of which is incorporated herein by reference.

For the preparation of tobacco products, such as smokeless tobacco products, it is typical for harvested plants of the *Nicotiana* species to be subjected to a curing process. Descriptions of various types of curing processes for various types of tobaccos are set forth in Tobacco Production, Chemistry and Technology, Davis et al. (Eds.) (1999). Exemplary techniques and conditions for curing flue-cured tobacco are set forth in Nestor et al., Beitrage Tabakforsch. Int, 20, 467-475 (2003) and U.S. Pat. No. 6,895,974 to Peele, which are incorporated herein by reference. Representative techniques and conditions for air curing tobacco are set forth in Roton et al., Beitrage Tabakforsch. Int., 21, 305-320 (2005) and Staaf et al., Beitrage Tabakforsch. Int., 21, 321-330 (2005), which are incorporated herein by reference. Certain types of tobaccos can be subjected to alternative types of curing processes, such as fire curing or sun curing. Typically, harvested tobaccos that are cured are then aged.

At least a portion of the plant of the *Nicotiana* species (e.g., at least a portion of the tobacco portion) can be employed in various forms. For example, various parts or portions of the plant of the *Nicotiana* species can be employed. Additionally, various parts or portions of the plant of the *Nicotiana* species can be subjected to various types of post-harvest processing treatments or processes. For example, such parts or portion of the plant can be separated into individual parts or pieces, physically processed or subjected to extraction (e.g., solvent extraction using polar solvents, organic solvents, or supercritical fluids, chromatography, distillation, filtration, recrystallization, and/or solvent-solvent partitioning). See, for example, US Patent Appl. Pub. No. 2013/0312774 to Holton, which is incorporated herein by reference.

According to one aspect of the present disclosure, the tobacco-related material or product 300 that may be packaged with respect to the container (i.e., including a tubular member 200 and a dispensing mechanism 400) can be characterized as being moist snuff. Exemplary types of moist snuff tobacco products that have been commercially available have been marketed by American Snuff Co., LLC under the brand names Grizzly Extra Long Cut, Grizzly Long Cut 1900, Grizzly Long Cut Wintergreen, Grizzly Long Cut Mint, Cougar Long Cut Natural, Kodiak Wintergreen, Kodiak Mint and Kodiak Straight Long Cut; US Smokeless Tobacco Company under the brand names Copenhagen Snuff Fine Cut, Copenhagen Long Cut Straight, Copenhagen Neat Cut Natural, Skoal Original Fine Cut Wintergreen, Skoal Long Cut Wintergreen, Skoal X-tra Long cut Wintergreen Blend, Skoal Net Cut Wintergreen, Skoal ReadyCut Straight, Red Seal Fine Cut Natural, Red Seal Long Cut Wintergreen, Husky Fine Cut Natural and Husky Fine Cut Straight; Pinkerton Tobacco Co. LP under the brand names Timber Wolf Long Cut Wintergreen, Timber Wolf Fine Cut Wintergreen, Longhorn Fine cut Natural, Long Horn Long cut Wintergreen, Red Man Fine Cut Natural and Red Man Long Cut Wintergreen; Lake Erie Tobacco Company under the brand names Seneca Original Long Cut and Seneca Wintergreen Long Cut; and National Tobacco Company, LP under the brand name Stoker's Long Cut Natural.

For certain types of smokeless tobacco products, such as moist snuff types of products, it may be desirable to incorporate venting features or provisions into the container (i.e., such that the container is "breathable"). Such venting mechanisms have been employed for the types of containers traditionally used for the distribution of commercially available moist snuff products. Accordingly, in some aspects of the present disclosure, such venting provisions (see, e.g., element 150 in FIG. 1, wherein such venting provisions may comprise, one or more holes, opening, pores, airflow passage means, or other orifice (or alternatively any one of a number of rib features) facilitating air or gas flow through, into, or out of the tubular member 200) may be provided in relation to the tubular member 200, the cover or closure member 275, and/or the dispensing mechanism 400, as necessary or desired, particularly when the tobacco-related product 300 comprises a moist snuff type of product, and may be configured to facilitate the exchange of gases between the interior of the tubular member 200 and the atmosphere or environment external to the tubular member 200. Various types of venting mechanisms and structures for containers of moist snuff products are described, for example, in U.S. Pat. No. 4,190,170 to Boyd; U.S. Pat. No. 8,215,482 to Cronin et al. and U.S. Pat. No. 8,556,070 to Bried et al.; and US Pat. App. Pub. No. 2012/0193265 to Patel et al.; which are incorporated herein by reference.

In some aspects of the present disclosure, tobacco-related material or product 300 that is packaged with respect to the container (i.e., including a tubular member 200 and a dispensing mechanism 400) can be can be characterized as being a loose snus type of product. Exemplary types of loose snus tobacco products that have been commercially available have been marketed by Swedish Match AB under the brand names General Los, Goteborgs Prima Fint Los, Goteborgs Rape Los, Grovsnus Los, Kardus Superior Blend Los, Kronan Los and Probe Los; and Fiedler & Lundgren AB under the brand names Granit Loose Snus and Knekt Loose Snus.

In other aspects of the present disclosure, tobacco-related material or product 300 that is packaged with respect to the container (i.e., including a tubular member 200 and a dispensing mechanism 400) can be characterized as being in a pouch or discrete portion form. In one regard, moist snuff can be incorporated within a pouch; and exemplary types of pouched moist snuff products that have been commercially available have been marketed by American Snuff Co., LLC under the brand names Grizzly Wintergreen Pouches, Grizzly Straight Pouches, Grizzly Snuff Pouches, Grizzly Mint Pouches and Kodiak Wintergreen Pouches; US Smokeless Tobacco Company under the brand names Copenhagen Pouches Straight, Skoal Bandits Wintergreen, Skoal Pouches Wintergreen and Red Seal Pouches Straight; Pinkerton Tobacco Co. LP under the brand names Timber Wolf Pouches Wintergreen and Longhorn Pouches Wintergreen. In another regard, snus types of tobacco formulations can be incorporated within a pouch; and exemplary types of pouched snus products that have been commercially available have been marketed by R. J. Reynolds Tobacco Company under the brand name Camel Snus Frost; US Smokeless Tobacco Company under the brand names Copenhagen Natural and Skoal Wintergreen; Swedish Match AB under the brand names Catch Licorice Portion Original Mini and Ettan Portion Large White; and Fiedler & Lundgren AB under the brand names Granit White Portion, G20 White Portion (Original), Mocca Mint and Knekt Portion.

In yet other aspects of the present disclosure, tobacco-related material or product 300 that is packaged with respect to the container (i.e., including a tubular member 200 and a dispensing mechanism 400) can have the form of a plurality of individual parts or pieces. Generally, such types of tobacco-related materials or products can have the form or general shape of cylinders or pellets, beans or ovoids, capsules, compressed or formed spheres or bits, tablets, lozenges, or the like. For example, the tobacco-related material or product can have a form that can be characterized as compressed tobacco tablets, such a product that has been commercially available as Interval Tobacco Tabs through Brown & Williamson Tobacco Corporation. Alternatively, the tobacco-related material or product can have the form of compressed tobacco pieces that have been marketed under the tradename Camel Orbs by R. J. Reynolds Tobacco Company. The tobacco-related material or product also can have the form of parts or pieces of so-called plug type chewing tobacco, such as can be provided by suitable adaptation of products that have been commercially available as Redman Original, Granger Select and Beech-Nut Original by Pinkerton Tobacco Co. LP. Exemplary pieces of a tobacco-related material or product have the form of pieces, pellets or bits, such as those available under the tradename Oliver Twist Original and Oliver Twist Sunberry by House of Oliver Twist AIS (See, e.g., U.S. Pat. No. 8,635,847 to Knudsen). Additionally, processed tobacco-related materials or products can be formed into generally disc-shaped pieces; such as, for example, as a plurality of disc-shaped pieces each having a central passageway, so that those discs can be stacked on top of each other and provide for the central ejection mechanism of the container. Other representative types of tobacco-related materials or products, product formulations and product configurations are set forth, discussed and referenced, for example, in US Pat. App. Pub. Nos. 2011/0220130 to Mua et al., 2013/0206150 to Duggins et al., 2013/0206153 to Beeson et al., 2013/0263870 to Cantrell et al., 2013/0274296 to Jackson et al. and 2013/0312774 to Holton, which are incorporated herein by reference.

In still other aspects of the present disclosure, tobacco-related material or product 300 that is packaged with respect to the container (i.e., including a tubular member 200 and a dispensing mechanism 400) can otherwise be characterized as being based on loose leaf tobacco, plug tobacco, tobacco pellets, tobacco bits, or otherwise tobacco pieces, or combinations thereof. In some instances, the tobacco-related material or product according to such aspects may include a binder material or substance to facilitate or promote cohesion of the product introduced into container/tubular member. Such a binder material or substance may include, for example, gum arabic, gum ghatti, guar gum, pectin, psyllium, carrageenan, xanthan, tragacanth, caraya, locust bean gum, konjac gum, agar, gelatin, an alginate, rice flour, wheat flour, oat flour, corn flour, rye flour, potato flour, starches, modified starches, whey, lactose, sucrose, maltitol, sorbitol, xylitol, carboxymethyl cellulose, microcrystalline cellulose, hydroxypropyl cellulose, methylcellulose and hydroxypropyl methylcellulose. One or more of such representative binders materials or substance may be incorporated into liquid (e.g., aqueous) formulations that are used for the preparation, for example, of moist snuff tobacco-related materials or products. For example, at least one binder can be incorporated in a desired amount into a casing formulation that is used to moisten and flavor a tobacco mixture used to produce a moist snuff product. As a result, the resulting flavored moist snuff product may have the form of a mixture of parts or pieces of moist tobacco, as well as a desired consistency for use with the previously described types of dispensing containers.

In one representative example, the tobacco-related material or product 300 that may be packaged with respect to the container (i.e., including a tubular member 200 and a dispensing mechanism 400) may be of the moist snuff type based, for instance, on a tobacco formulation comparable to that used for the formulation of Grizzly Long Cut Wintergreen. In such instances, about 35 parts of the cut tobacco blend used to formulate that product is combined with a liquid casing formulation. The casing formulation is a solution comprised of about 50 parts water, about 4 parts of a sodium alginate binder available as Manucol LD from FMC BioPolymer, and about 11 parts of the casing components that are conventionally used to formulate the Grizzly Long Cut Wintergreen product. The tobacco pieces and casing formulation are mixed at room temperature, using a blender, into a generally dough-like consistency that incorporates a mixture of the individual moist pieces of flavored tobacco. The dough-like formulation then is incorporated within a generally tubular container of the type described with reference to FIG. 1, by pressing a portion of that formulation into the tubular container. The tobacco pieces have the propensity or affinity to form or stick together (i.e., to form a cohesive entity), and hence the overall formulation can be characterized as more cohesive in nature than a comparable moist snuff formulation not incorporating a sodium alginate binder. As such, the moist collection of tobacco pieces can be dispensed from the generally tubular container in the form of a generally cohesive portion of a collection or mixture of multiple pieces of moist snuff. The formulation can be dispensed as a loosely formed mixture (e.g., a portion that is not characterized as independently granular, but rather, a form that is somewhat consistent/cohesive in its integrity and that is capable of being dispersed into its individual or relatively smaller pieces when introduced into the mouth of the moist snuff user).

Many modifications and other aspects of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. A dispensing system for a tobacco product, comprising:

a tubular member having a dispensing end;

a heterogeneous tobacco product received as a single unitary element within the tubular member, the heterogeneous tobacco product comprising portions of tobacco and water forming a moist cohesive mass exclusive of a carrier material;

a dispensing mechanism operably engaged with the tubular member, the dispensing mechanism comprising:

an elongate threaded member extending along a longitudinal axis of the tubular member;

an actuator engaged with and arranged to rotate the threaded member about the longitudinal axis; and a support member in communication with the single unitary element of the heterogeneous tobacco product substantially opposite to the dispensing end, the support member being arranged to resist rotation about the longitudinal axis and to threadedly engage the threaded member, the support member thereby being arranged to move along the longitudinal axis in response to rotation of the threaded member by the actuator to direct a user-selected portion of the single unitary element of the heterogeneous tobacco product outwardly of the tubular member through the dispensing end; and a closure member engaged with the dispensing end of the tubular member, the closure member being movable between a closed position and an open position so as to close the dispensing end in the closed position and to allow the user-selected portion of the single unitary element of the heterogeneous tobacco product to be dispensed through the dispensing end in the open position, the closure member being further configured to move laterally between the open position and closed position so as to sever the user-selected portion of the single unitary element extending outwardly of the dispensing end from a remaining portion of the single unitary element of the heterogeneous tobacco product within the tubular member.

2. The system of claim 1, wherein the dispensing mechanism is operably engaged with the tubular member opposite to the dispensing end.

3. The system of claim 1, wherein the dispensing mechanism is configured to retract the single unitary element of the heterogeneous tobacco product or the remaining portion thereof into the tubular member through the dispensing end.

4. The system of claim 1, wherein the heterogeneous tobacco product comprises one of moist snuff, snus, loose leaf tobacco, tobacco pieces, and combinations thereof.

5. The system of claim 1, wherein the dispensing mechanism is configured to be actuated in discrete increments so as to dispense a user-selected predetermined amount of the single unitary element of the heterogeneous tobacco product through the dispensing end for each actuation increment.

6. The system of claim 1, wherein the heterogeneous tobacco product further comprises any one of at least one salt, at least one buffer, at least one sweetener, flavoring agents commonly used for flavoring smokeless tobacco formulations, at least one binding agent, at least one preservative agent, and combinations thereof.

7. The system of claim 6, wherein the binding agent is selected from the group consisting of gum arabic, gum ghatti, guar gum, pectin, psyllium, carrageenan, xanthan, tragacanth, caraya, locust bean gum, konjac gum, agar, gelatin, alginate, rice flour, wheat flour, oat flour, corn flour, rye flour, potato flour, starch, modified starch, whey, lactose, sucrose, maltitol, sorbitol, xylitol, carboxymethyl cellulose, microcrystalline cellulose, hydroxypropyl cellulose, methylcellulose, hydroxypropyl methylcellulose, and combinations thereof.

8. The system of claim 1, wherein the closure member is configured to pivot in a plane of the dispensing end about a pivot point disposed externally to the dispensing end so as to be laterally movable to close the dispensing end in the closed position and to allow the user-selected portion of the single unitary element of the heterogeneous tobacco product to be dispensed through the dispensing end in the open position, the closure member being further configured to pivot about the pivot point from the open position to the closed position so as to sever the user-selected portion of the single unitary element of the heterogeneous tobacco product extending outwardly of the dispensing end from the remaining portion of the single unitary element of the heterogeneous tobacco product within the tubular member.

9. A method of dispensing a tobacco product, comprising:

actuating a dispensing mechanism operably engaged with a tubular member having a dispensing end, the tubular member having received a heterogeneous tobacco product therein as a single unitary element, the heterogeneous tobacco product comprising portions of tobacco and water forming a moist cohesive mass exclusive of a carrier material, actuating the dispensing mechanism comprising:

actuating an actuator engaged with an elongate threaded member extending along a longitudinal axis of the tubular member so as to rotate the threaded member about the longitudinal axis; and moving a support member along the longitudinal axis in response to rotation of the threaded member by the actuator, the support member being in communication with the single unitary element of the heterogeneous tobacco product substantially opposite to the dispensing end, being arranged to resist rotation about the longitudinal axis, and being threadedly engaged with the threaded member;

directing a user-selected portion of the single unitary element of the heterogeneous tobacco product outwardly of the tubular member through the dispensing end, in response to actuation of the dispensing mechanism; and moving a closure member laterally from an open position to a closed position, the closure member being engaged with the dispensing end of the tubular member and being arranged to close the dispensing end in the closed position and to allow the user-selected amount of the single unitary element of the heterogeneous tobacco product to be dispensed through the dispensing end in the open position, and severing the user-selected portion of the single unitary element extending outwardly of the dispensing end from a remaining portion of the single unitary element of the heterogeneous tobacco product within the tubular member.

10. The method of claim 9, wherein actuating a dispensing mechanism further comprises actuating a dispensing mechanism operably engaged with the tubular member opposite to the dispensing end.

11. The method of claim 9, further comprising actuating the dispensing mechanism to retract the single unitary element of the heterogeneous tobacco product or the user-selected portion thereof into the tubular member through the dispensing end.

12. The method of claim 9, wherein directing a user-selected portion of the single unitary element of the heterogeneous tobacco product further comprises directing a user-selected portion of the single unitary element of the heterogeneous tobacco product, comprising one of moist snuff, snus, loose leaf tobacco, tobacco pieces, and combinations thereof, outwardly of the tubular member through the dispensing end.

13. The method of claim 9, wherein actuating the dispensing mechanism comprises actuating the dispensing mechanism in discrete increments so as to dispense a user-selected predetermined amount of the single unitary element of the heterogeneous tobacco product through the dispensing end for each actuation increment.

14. The method of claim 9, wherein directing a user-selected portion of the single unitary element of the heterogeneous tobacco product further comprises directing a user-selected portion of the single unitary element of the heterogeneous tobacco product, which further comprises any one of at least one salt, at least one buffer, at least one sweetener, flavoring agents commonly used for flavoring smokeless tobacco formulations, at least one binding agent, at least one preservative agent, and combinations thereof, outwardly of the tubular member through the dispensing end.

15. The method of claim 9, wherein moving the closure member laterally comprises pivoting the closure member laterally in a plane of the dispensing end, and about a pivot point disposed externally to the dispensing end, from the open position to the closed position, to sever the user-selected portion single unitary element of the heterogeneous tobacco product extending outwardly of the dispensing end from the remaining portion of the single unitary element of the heterogeneous tobacco product within the tubular member.

* * * * *